US009797678B2

(12) United States Patent
Tseng

(10) Patent No.: US 9,797,678 B2
(45) Date of Patent: Oct. 24, 2017

(54) ELECTROMAGNETIC VALVE ACTIVATED FIRING MECHANISM OF AIRSOFT GUN

(71) Applicant: Jui-Fu Tseng, Yilan (TW)

(72) Inventor: Jui-Fu Tseng, Yilan (TW)

( * ) Notice: Subject to any disclaimer, the term of this patent is extended or adjusted under 35 U.S.C. 154(b) by 0 days.

(21) Appl. No.: 15/255,165

(22) Filed: Sep. 2, 2016

(65) Prior Publication Data

US 2016/0363414 A1 Dec. 15, 2016

(51) Int. Cl.
*F41B 11/723* (2013.01)
*F41B 11/73* (2013.01)
*F41B 11/62* (2013.01)

(52) U.S. Cl.
CPC ..... *F41B 11/723* (2013.01); *F41B 11/73* (2013.01); *F41B 11/62* (2013.01)

(58) Field of Classification Search
CPC ..... F41B 11/62; F41B 11/72–11/724; F41B 11/73
See application file for complete search history.

(56) References Cited

U.S. PATENT DOCUMENTS 7,597,097 B2 * 10/2009 Gan ..... F41B 11/721 124/73
7,798,364 B1 * 9/2010 Eddins ..... F41B 9/00 124/63
7,841,330 B2 * 11/2010 Liao ..... F41B 11/723 124/77
7,870,852 B2 * 1/2011 Halmone ..... F41B 11/73 124/77
8,256,406 B1 * 9/2012 Kirkpatrick ..... F41B 11/723 102/440
8,602,784 B2 * 12/2013 Dvorak ..... F41A 33/02 434/11
9,638,490 B1 * 5/2017 Shen ..... F41B 11/71
2006/0027221 A1 * 2/2006 Farrell ..... F41B 11/723 124/31
2016/0047620 A1 * 2/2016 Tseng ..... F41B 11/721 124/65

* cited by examiner

*Primary Examiner* — Stephen Johnson
*Assistant Examiner* — Joshua T Semick

(57) ABSTRACT

A firing mechanism of an airsoft gun includes, in combination a gun body; a sleeve in a rear portion of the gun body; a discharge tube in a front end of the sleeve; a retaining ring on the front end of the sleeve; at least one assembly, each including an air canister and a piercing member facing the air canister; a locking member put on a rear end of the sleeve and configured to rotate to cause the piercing member to pierce the air canister of each of the at least one assembly; and an electromagnetic valve configured to activate by pulling a trigger. In response to opening the electromagnetic valve, pressurized air from the assembly drives a pellet out of the gun body.

1 Claim, 13 Drawing Sheets

ELECTROMAGNETIC VALVE ACTIVATED FIRING MECHANISM OF AIRSOFT GUN

BACKGROUND OF THE INVENTION

1. Field of the Invention

The invention relates to airsoft guns and more particularly to an electromagnetic valve activated firing mechanism of an airsoft gun.

2. Description of Related Art

A conventional firing mechanism of an airsoft gun includes a gun body; a stock extending rearward from the gun body; a trigger extending downward from the gun body; a gas cartridge containing pressurized gas disposed in the stock; a magazine releasably secured to the gun body; an actuator including a spring biased sliding bar including an external handle, a protrusion projecting downward from the sliding bar, a spring biased sliding rod disposed under the sliding bar, and a sliding block engaging the sliding rod and including a protuberance facing the gas cartridge; and a safety mechanism disposed adjacent to a trigger and including a safety lever, a cam disposed at one end of the safety lever and being co-rotatable with the safety lever, the cam having an annular shoulder, a spring biased rod aligned with the safety lever and spaced from the cam in an inoperative position.

While the airsoft gun incorporating the firing mechanism enjoys its success in the market, continuing improvements in the exploitation of firing mechanism of airsoft gun of this type are constantly being sought.

SUMMARY OF THE INVENTION

It is therefore one object of the invention to provide a firing mechanism of an airsoft gun comprising, in combination a gun body; a sleeve in a rear portion of the gun body; a discharge tube in a front end of the sleeve; a retaining ring on the front end of the sleeve; at least one assembly, each including an air canister and a piercing member facing the air canister; a locking member put on a rear end of the sleeve and configured to rotate to cause the piercing member to pierce the air canister of each of the at least one assembly; a spring biased discharge tube communicating with the at least one assembly; a first inlet passage with the discharge tube extending therein; a pressure adjustment chamber in a front end of the first inlet passage; a second space in the pressure adjustment chamber for storing pressurized air supplied from the at least one assembly via the discharge tube and the first inlet passage; a spring biased first piston in a rear portion of the second space; a first passage in front of the first inlet passage; an adjustment member threadedly secured to the pressure adjustment chamber and with the first inlet passage and the first passage formed therein; a third space between the first passage and the first piston; an axial tunnel through the first piston; a plug in a rear portion of the axial tunnel; at least one lateral hole through the first piston and communicating with the axial tunnel so that the compressed air in the second space having a pressure above a predetermine value pushes the first piston rearward to block the first passage, decrease a volume of the third space to about zero, and block the at least one lateral hole; a passageway in the gun body; a firing chamber communicating with the second space via the passageway and disposed besides the pressure adjustment chamber wherein the pressurized air is configured to enter the firing chamber via the second space; a spring biased second piston configured to block the firing chamber; a spring biased sliding member having an axial channel; an outlet facing a rear end of the sliding member; a third piston in the gun body; an outlet member communicating with both the second space and the passageway; a pressurized air guide channel for guiding the pressurized air from the passageway to the firing chamber wherein the pressurized air further enters a space between the second piston and the third piston, furthermore enters a first channel via a first guide hole adjacent to a rod in the second piston, and the pressurized air in turn enters the second piston via the first channel to cause the third piston to block the outlet; an electromagnetic valve under the firing chamber and being configured to activate by pulling a trigger; and a second inlet passage communicating with both the electromagnetic valve and the firing chamber wherein the second inlet passage is configured to open by opening the electromagnetic valve and the pressurized air flows from the second inlet passing to a rear end of the sliding member via a second guide hole, a first passage member, and a second passage member, the sliding member moves forward to push a pellet, force exerted to a front end of the third piston increases to open the outlet, the third piston moves rearward, and the pressurized air flowing from the firing chamber to drive the pellet out of the gun body.

The above and other objects, features and advantages of the invention will become apparent from the following detailed description taken with the accompanying drawings.

DETAILED DESCRIPTION OF THE INVENTION

Figure 1:
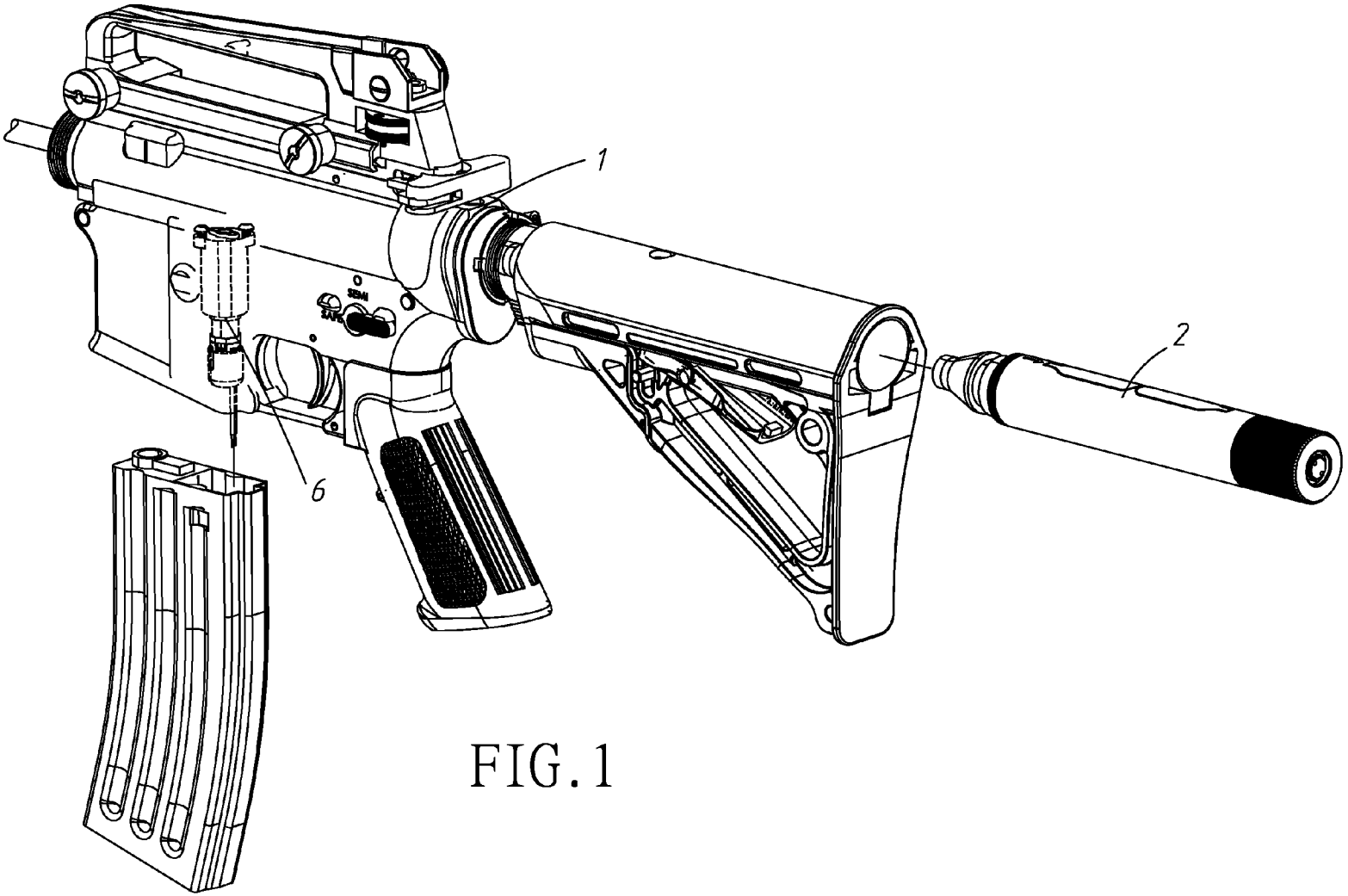
FIG. 1 is an exploded perspective view of an airsoft gun incorporating an electromagnetic valve activated firing mechanism according to the invention.
Figure 2:
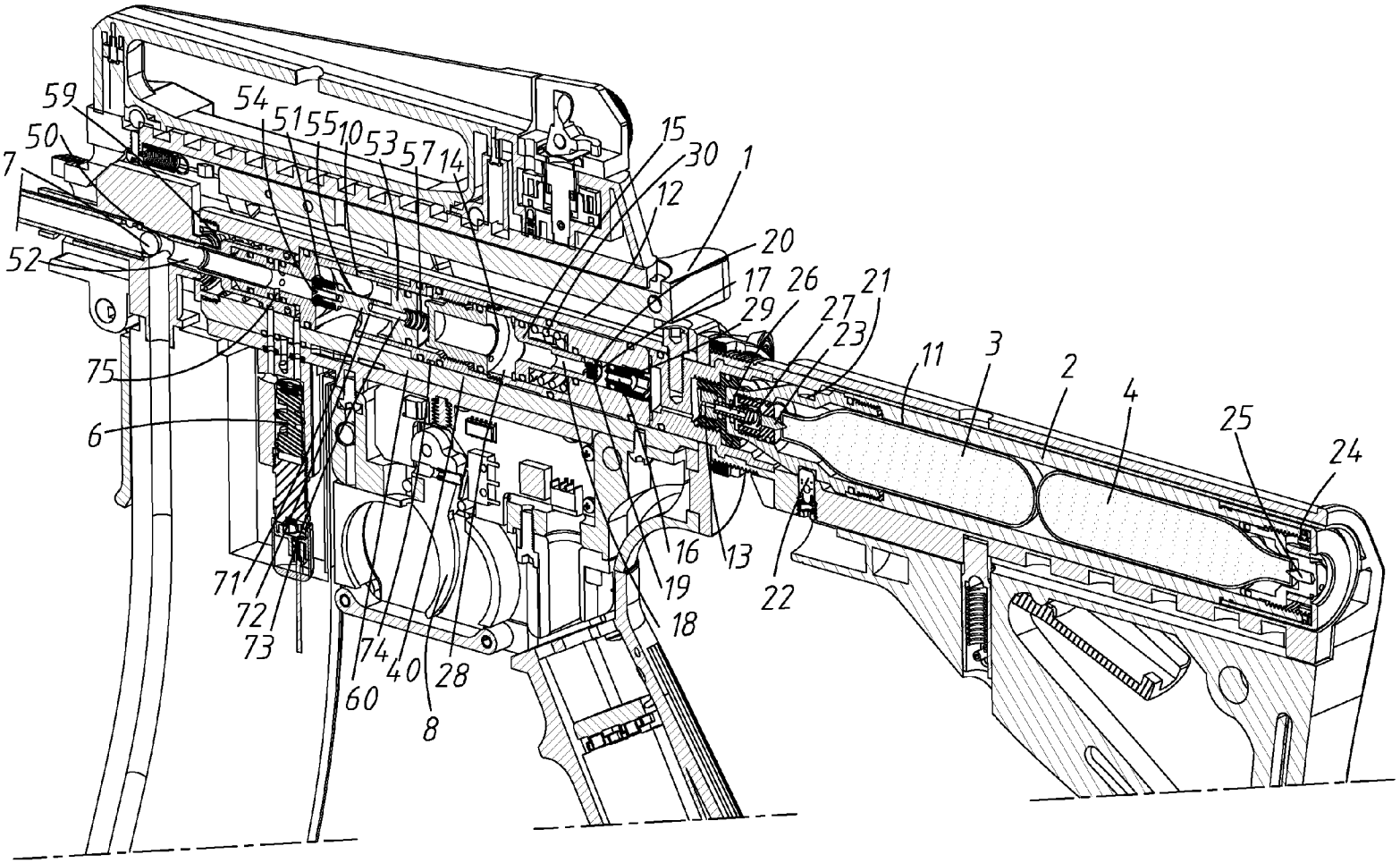
FIG. 2 is a longitudinal sectional view of the assembled airsoft gun.
Figure 3:
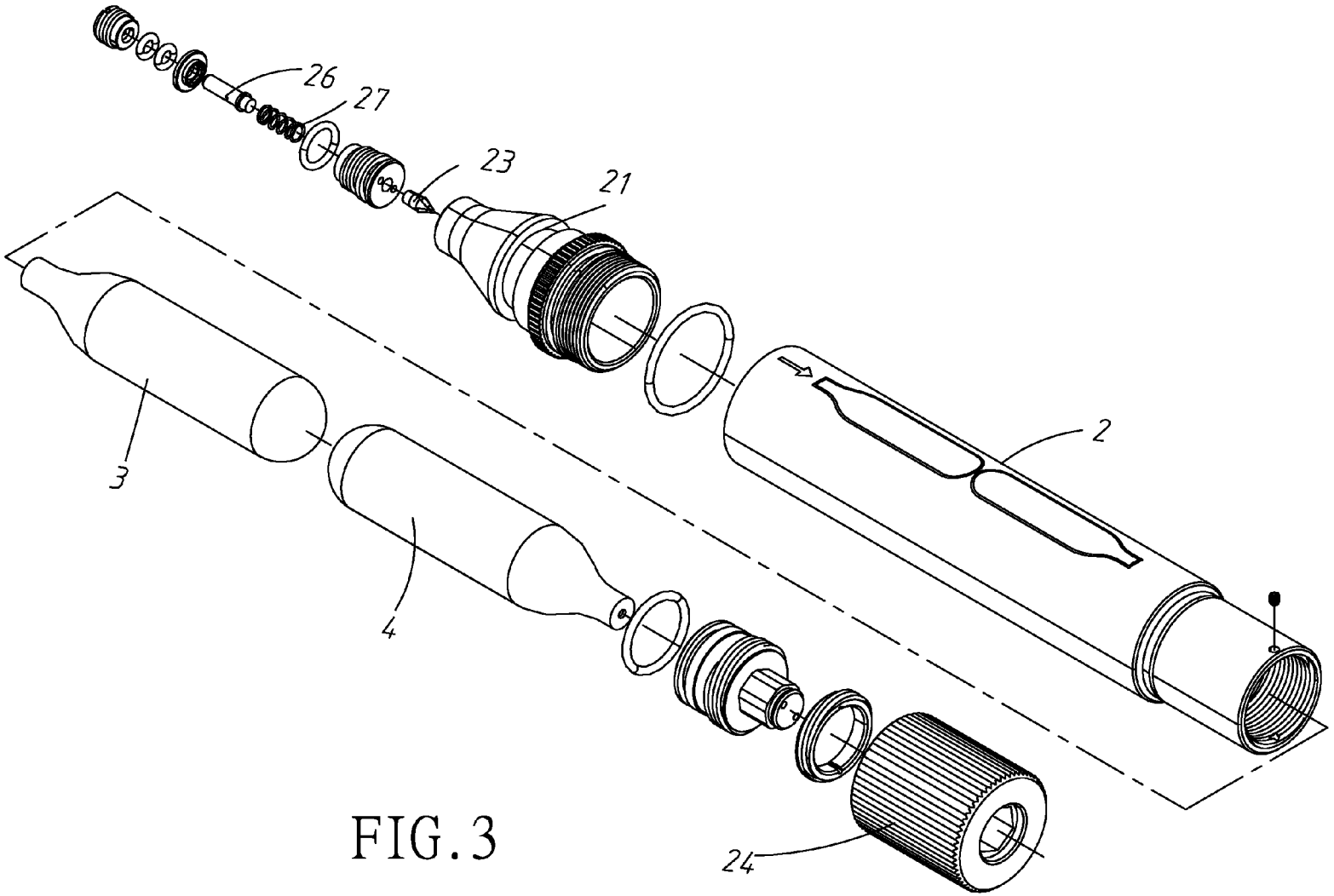
FIG. 3 is an exploded view of the air canister assembly.
Figure 4:
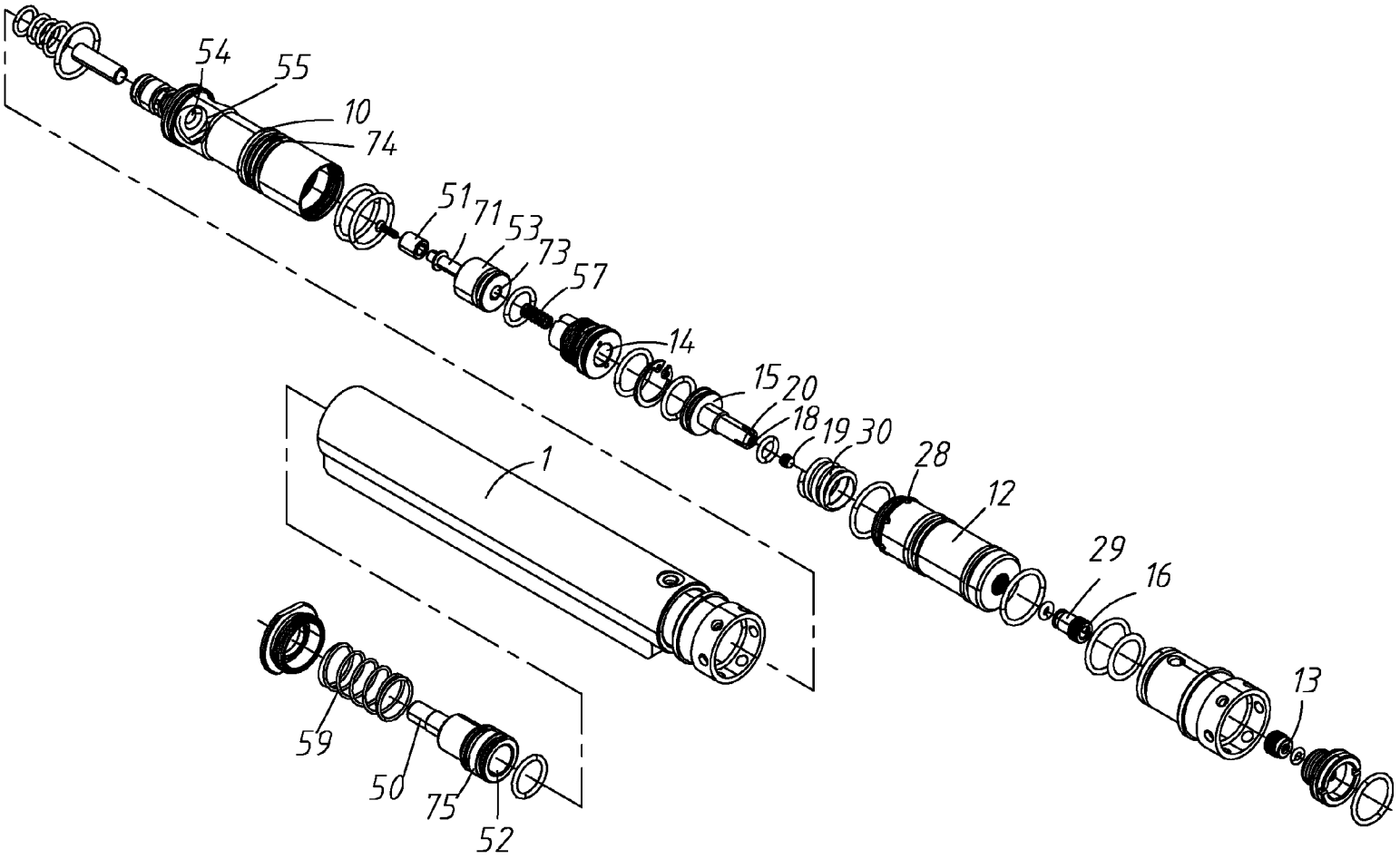
FIG. 4 is an exploded view of the pressure adjustment chamber and the firing chamber.
Figure 5:
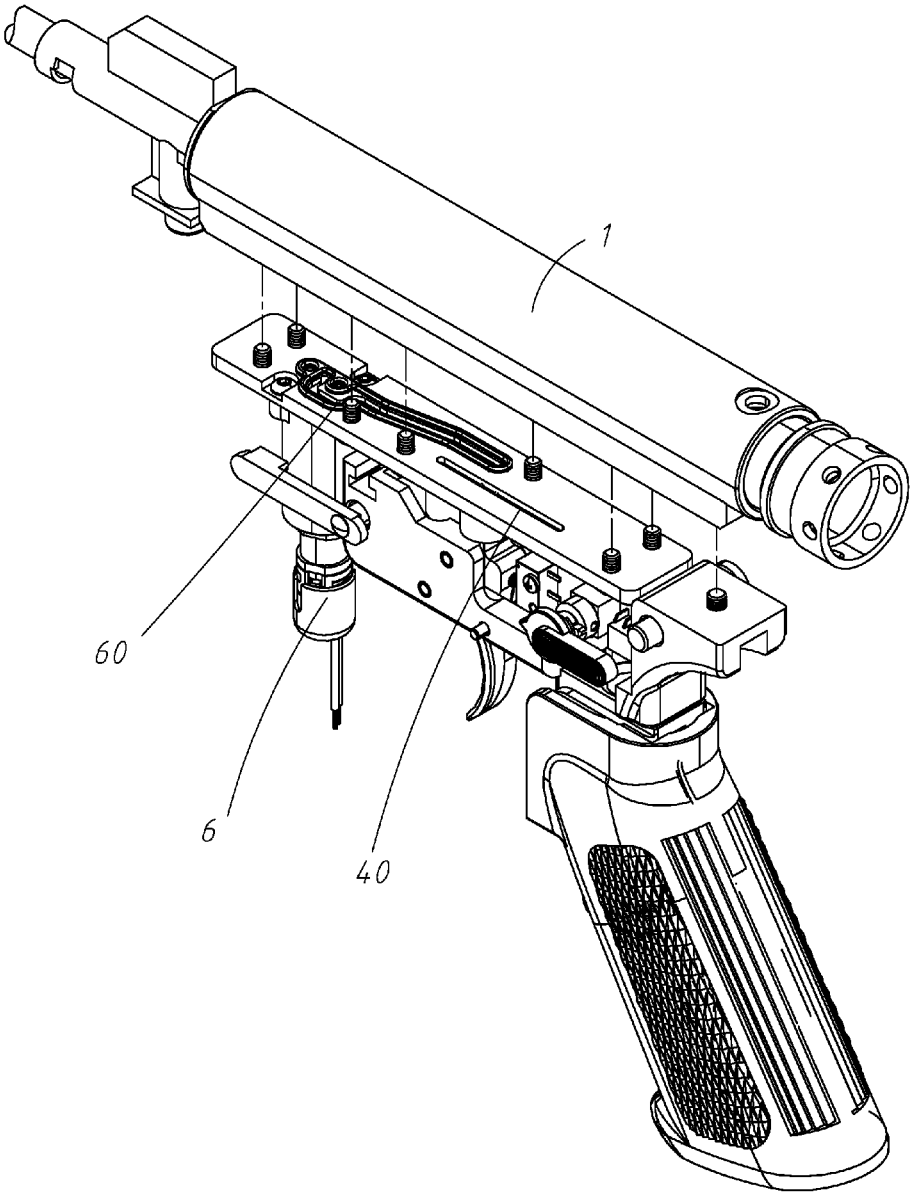
FIG. 5 is an exploded perspective view of the gun body and some components including the electromagnetic valve to be mounted from below.
Figure 6A:
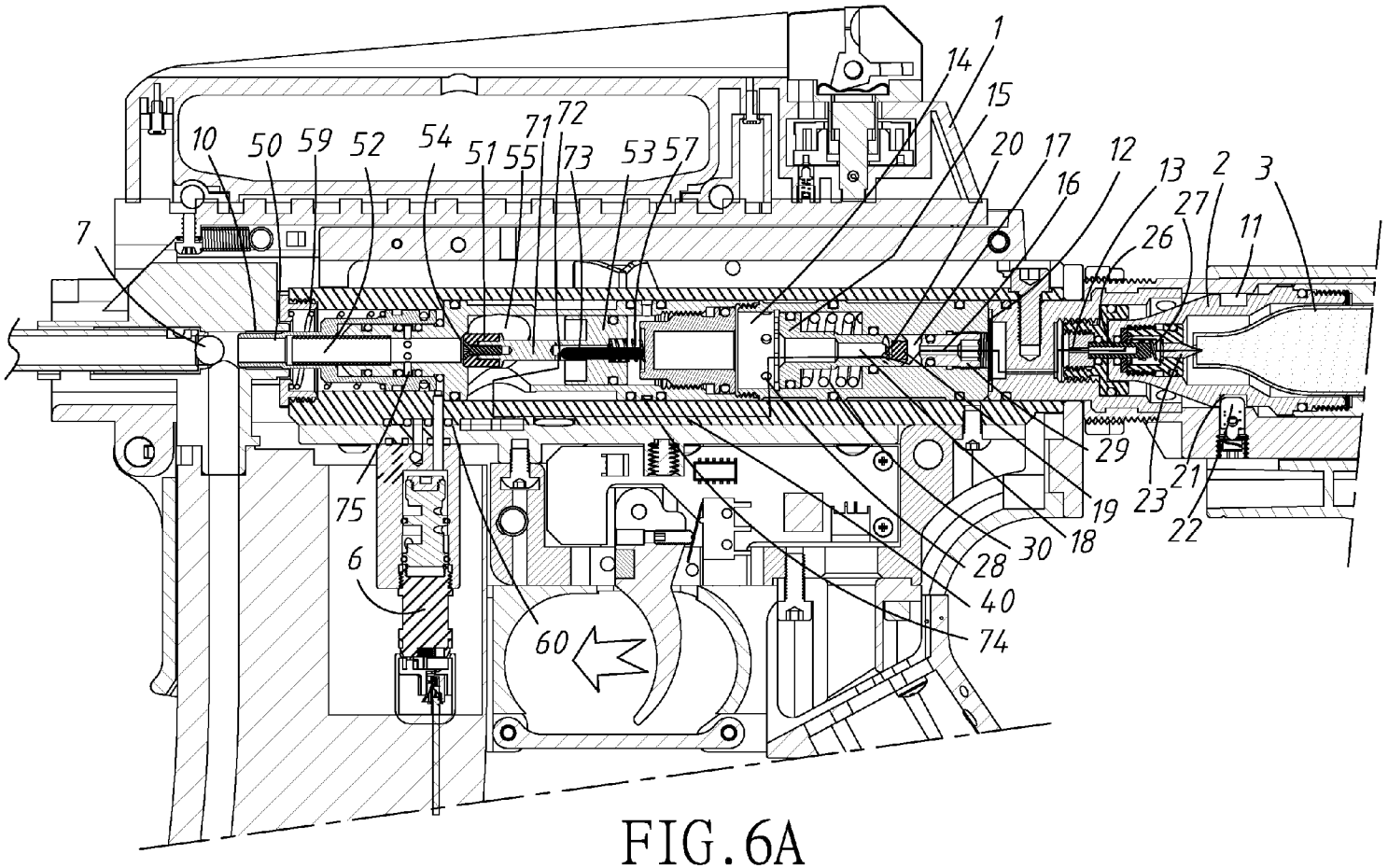
FIG. 6A is a longitudinal sectional view of the firing mechanism in a ready to fire position.
Figure 6B:
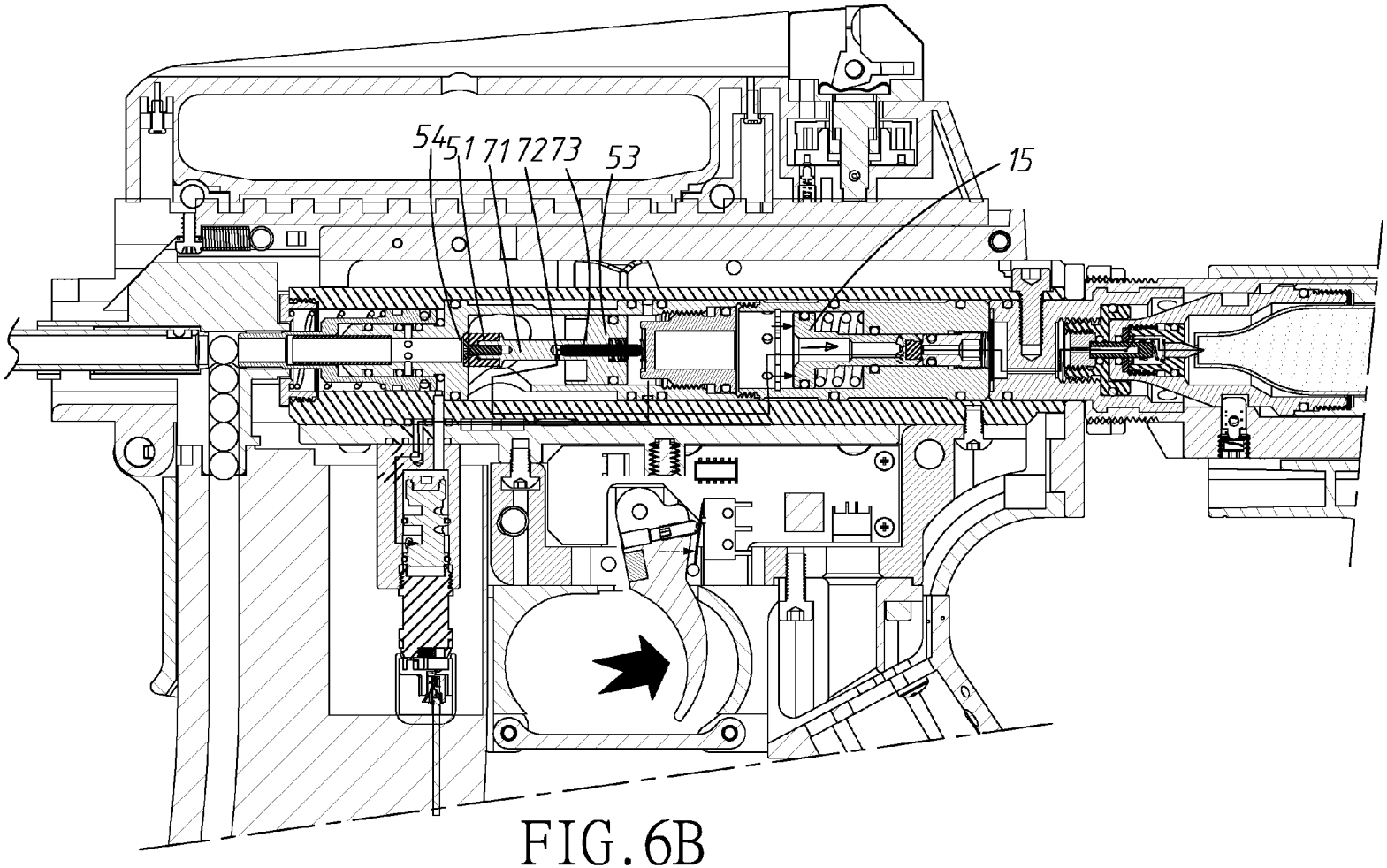
FIG. 6B is a view similar to FIG. 6A showing a pulling of the trigger and the first piston moved rearward to block air inlet.
Figure 6C:
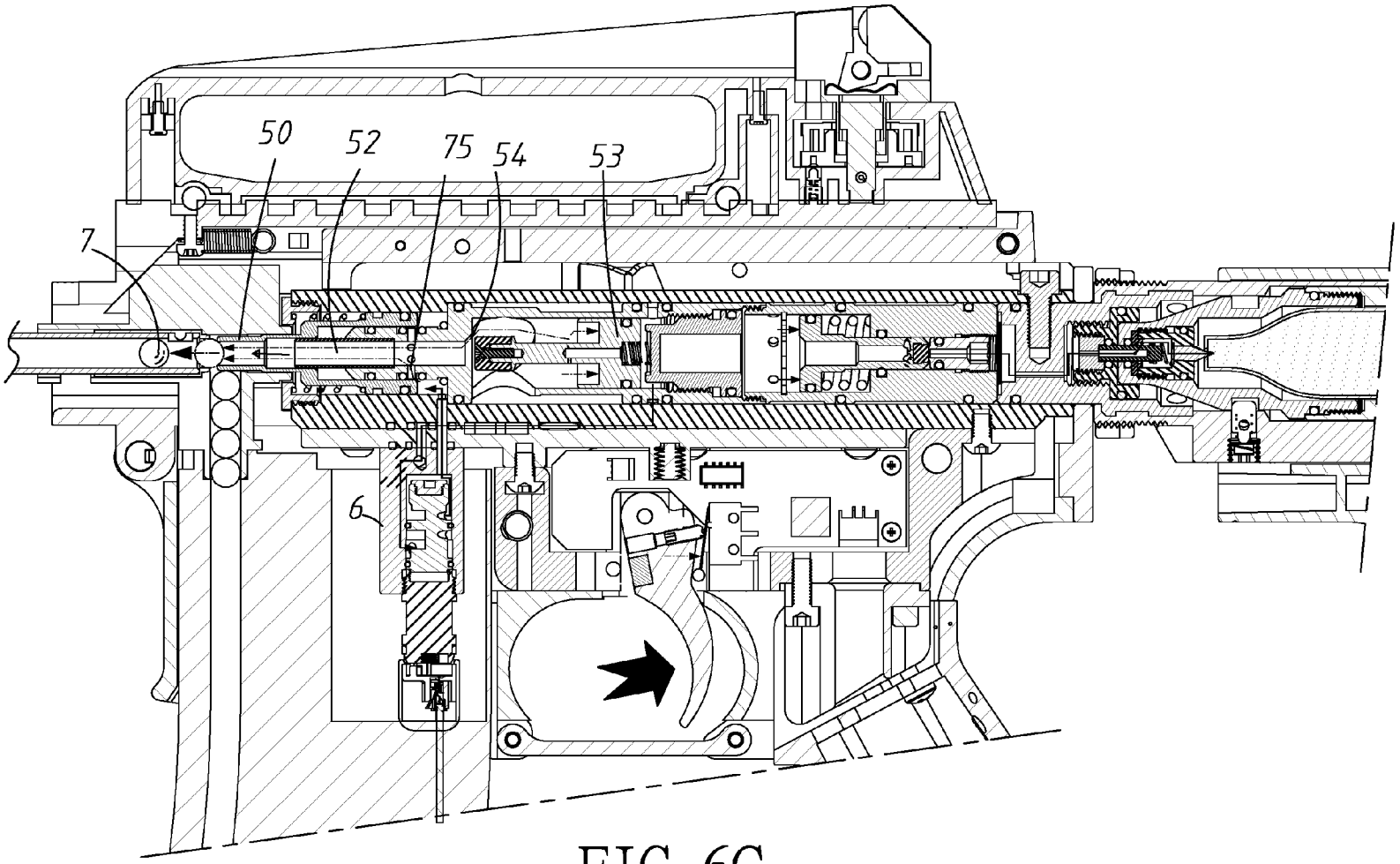
FIG. 6C is a view similar to FIG. 6B showing the sliding member moved forward to move the pellet into the barrel to be fired.
Figure 6D:
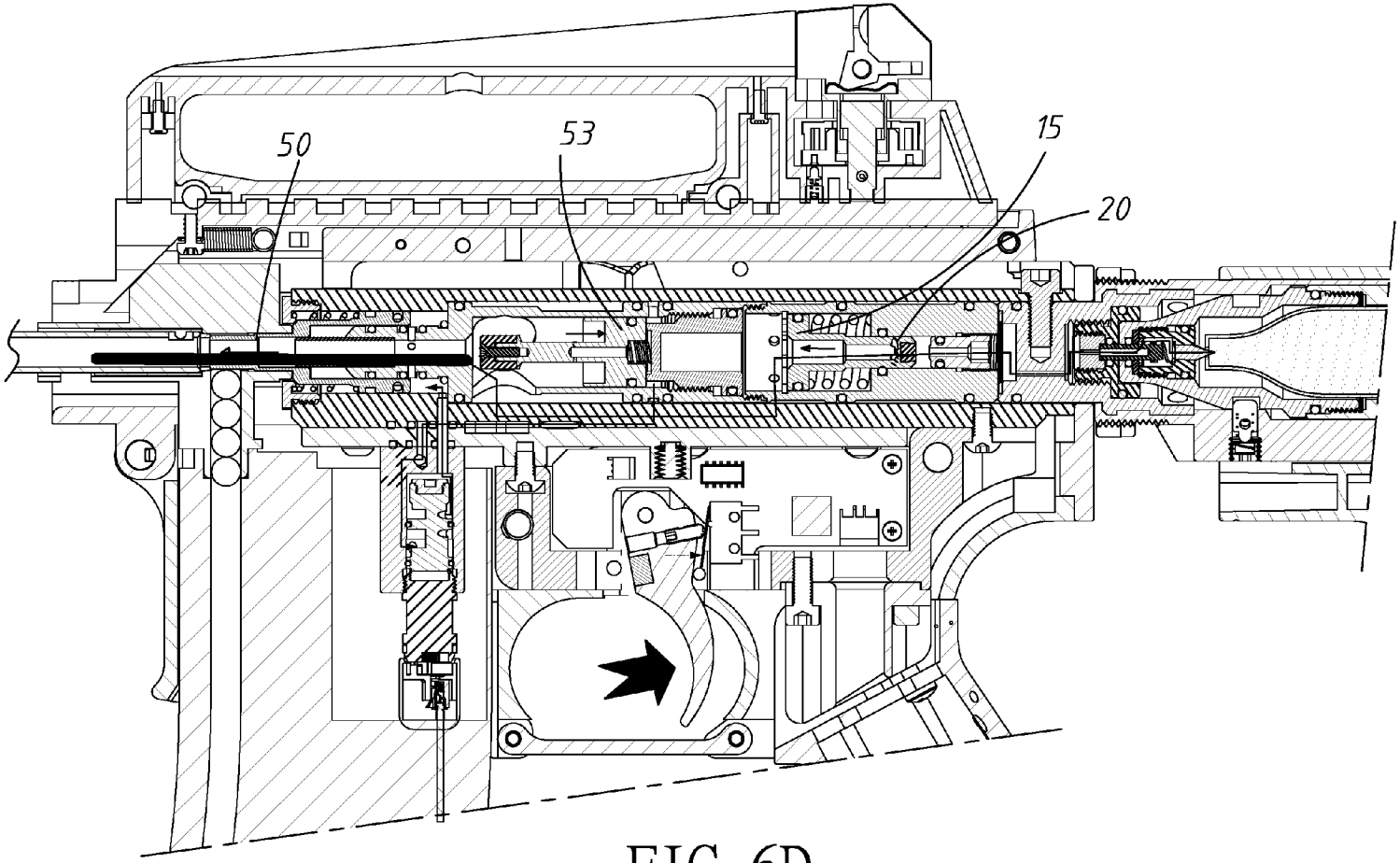
FIG. 6D is a view similar to FIG. 6C showing after firing both the second and third pistons moved rearward and the first piston moved forward.
Figure 7A:
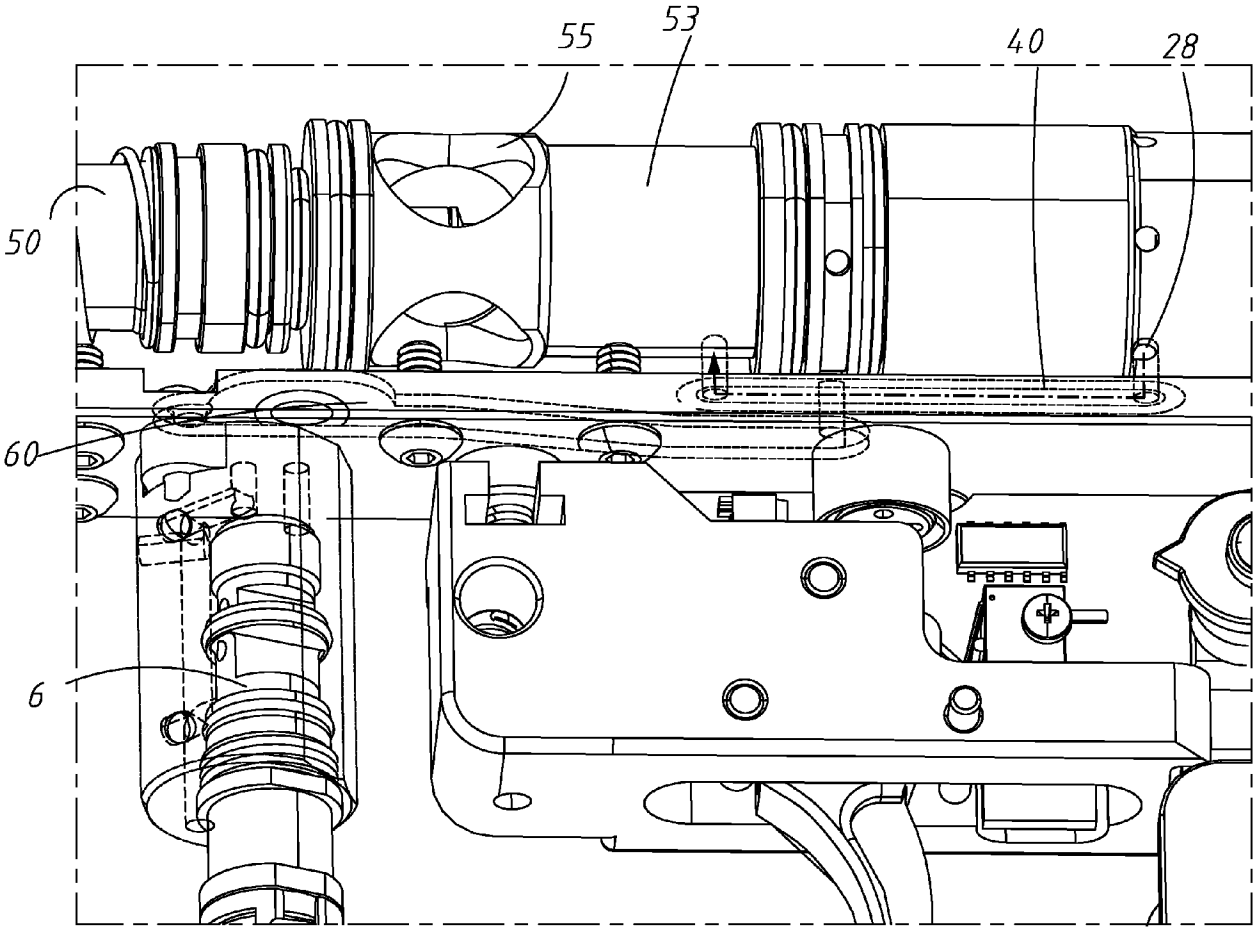
FIG. 7A is an enlarged view of the electromagnetic valve and adjacent components showing pressurized air to be flowed to its destination.
Figure 7B:
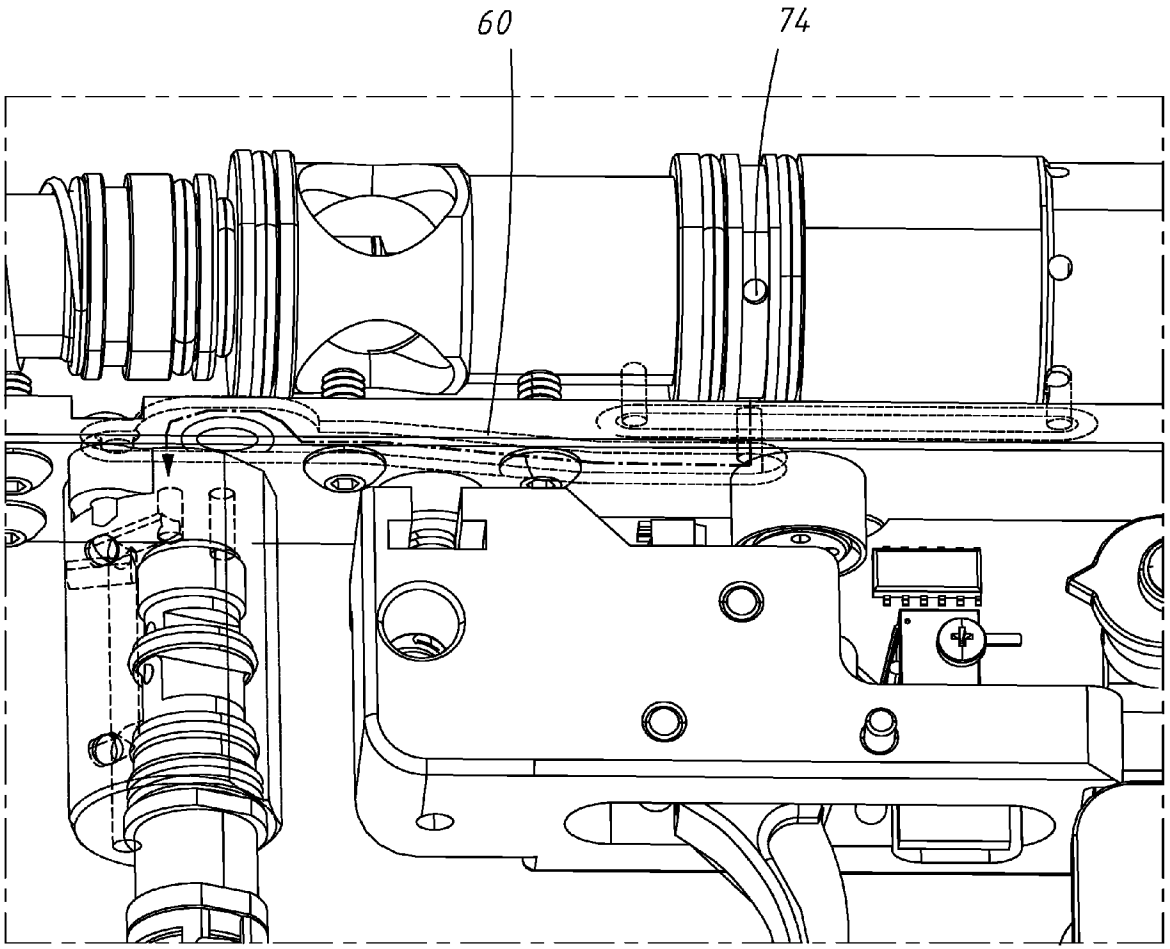
FIG. 7B is a view similar to FIG. 7A showing the pressurized air having reached the electromagnetic valve.
Figure 7C:
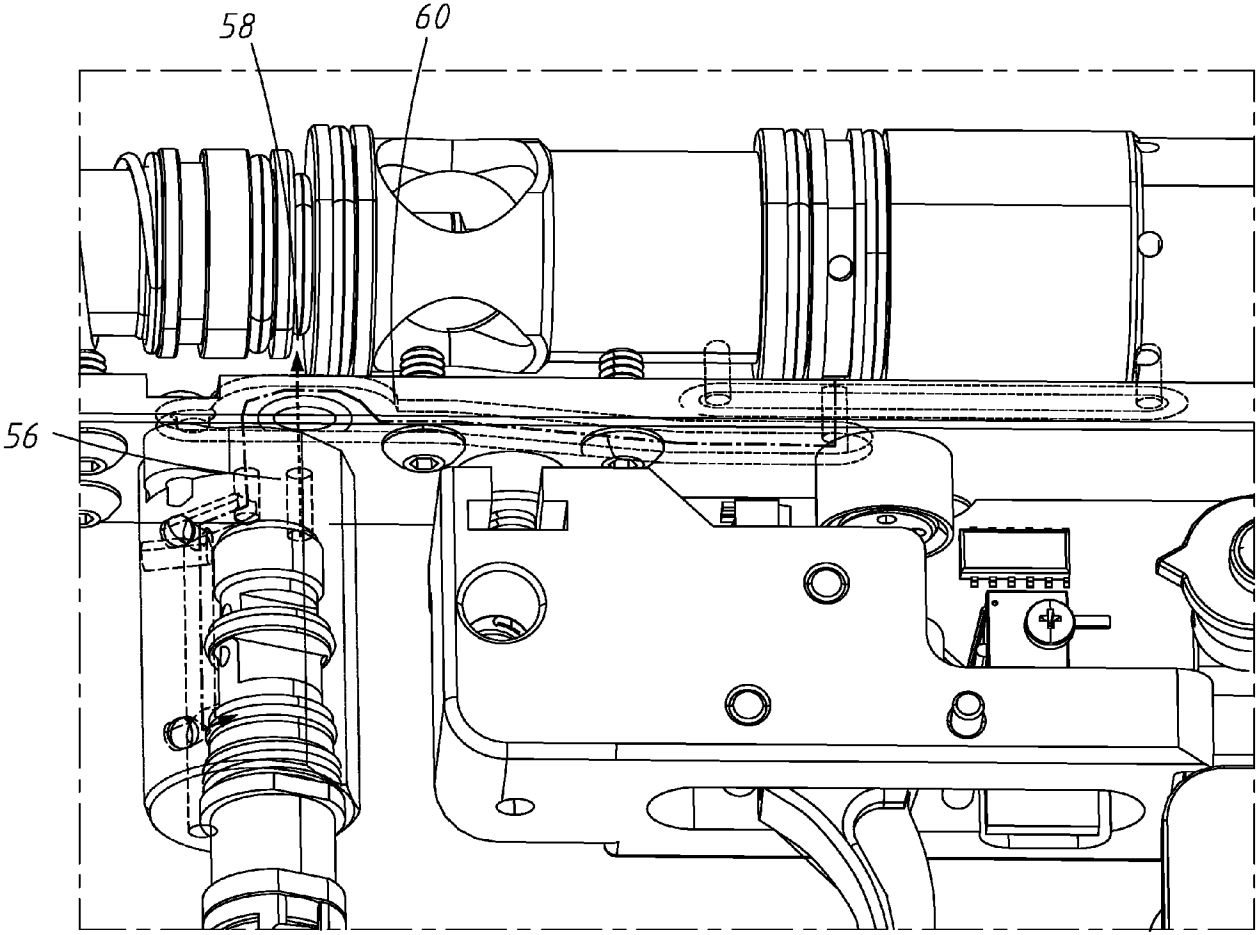
FIG. 7C is a view similar to FIG. 7B showing the pressurized air leaving the electromagnetic valve to be used for firing.
Figure 8:
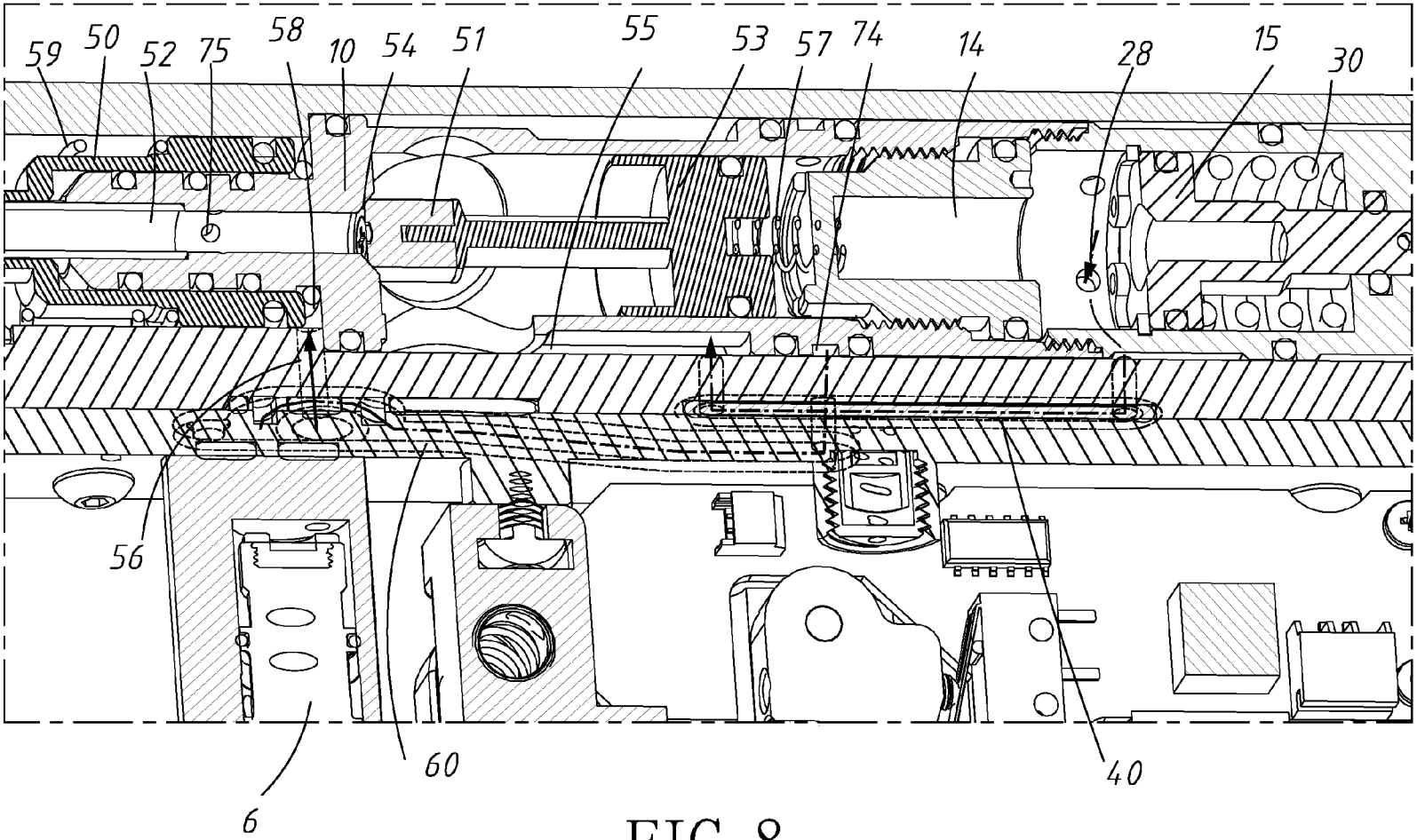
FIG. 8 is a longitudinal sectional view of the assembled components of FIG. 5 showing the pressurized air flowing to the electromagnetic valve.

Referring to FIGS. 1 to 8, an electromagnetic valve activated firing mechanism of airsoft gun in accordance with the invention comprises a gun body 1, a sleeve 2 in a first space 11 of a rear portion 1 of the gun body 1, a discharge tube 26 in a front end of the sleeve 2, an annular groove 21 on the front end of the sleeve 2, a retaining ring 22 put on the groove 21, opposing first and second air canisters 3 and 4 in the sleeve 2, a first piercing member 23 in the front end of the sleeve 2 facing the first air canister 3, a locking member 24 rotatably put on a rear end of the sleeve 2, a second piercing member 25 in the rear end of the sleeve 2 facing the second air canister 4, a rotation of the locking member 24 configured to cause the second piercing member 25 to pierce the second air canister 4 and cause the first piercing member 23 to pierce the first air canister 3, a helical spring 27 put on the discharge tube 26 so that the discharge tube 26 may extend into an inlet passage 13 in a rear end of a pressure adjustment chamber 12 in the gun body 1, a second space 14 in the pressure adjustment chamber 12 for storing pressurized air supplied from the first and second air canisters 3 and 4 via the discharge tube 26 and the inlet passage 13 and communicating with the inlet passage 13, a first piston 15 in a rear portion of the second space 14, a narrow passage 16 in front of the inlet passage 13, a third space 17 between the narrow passage 16 and the first piston 15, an axial tunnel 18 through the first piston 15, a plug 19 in a rear portion of the tunnel 18, a lateral hole 20 of the first piston 15 communicating with the tunnel 18 so that released compressed air accumulated in the second space 14 may increase to a value above a predetermine value to push the first piston 15 rearward to block the passage 16 and decrease the volume of the third space 17 to about zero and block the lateral hole 20; after pressure in the second space 14 dropped below the predetermine value, a torsion spring 30 put on the first piston 15 exerting force to push the first piston 15 to return to its original position and unblock the lateral hole 20, the second space 14 communicating with a firing chamber 10 via a passageway 40, the firing chamber 10 being besides the pressure adjustment chamber 12, the inlet passage 13 and the passage 16 being formed in an adjustment member 29 which is threadedly secured to the pressure adjustment chamber 12 so that pressure in the pressure adjustment chamber 12 increases when volume of the pressure adjustment chamber 12 increases, pressurized air configured to enter the firing chamber 10 via the second space 14, a second piston 51 configured to move to block the firing chamber 10, a sliding member 50 at a pellet inlet in the gun body 1, the sliding member 50 having an axial channel 52, an outlet 54 facing a rear end of the sliding member 50 being blocked by a third piston 53, an outlet member 28 communicating with both the second space 14 and the passageway 40, a pressurized air guide channel 55 for guiding pressurized air from the passageway 40 to the firing chamber 10 and in turn the pressurized air enters a space between the second piston 51 and the third piston 53, and further enters a channel 73 via a guide hole 72 adjacent to a rod 71 in the second piston 53, the pressurized air enters the second piston 51 via the channel 73 to cause the third piston 53 to block the outlet 54, an electromagnetic valve 6 under the firing chamber 10 and communicating with an inlet passage 60 which communicates with a hole 74 in the firing chamber 10, the inlet passage 60 being open by opening the electromagnetic valve 6 and in turn, the pressurized air flowing to a rear end of the sliding member 50 via a guide hole 75 in the firing chamber 10, i.e., pressurized air through the inlet passage 60 flowing to the rear end of the sliding member 50 via a second passage member 58 and a first passage member 56, then the sliding member 50 moving forward to push a pellet 7, at this time pressure in the second piston 51 decreased greatly and pressure in front of the third piston 53 increased to open the outlet 54, the third piston 53 moving rearward, the pressurized air flowing from the pressure adjustment chamber 12 to the pellet 7 via the firing chamber 10, thereby driving the pellet 7 out of the airsoft gun. Thereafter, force exerted on the second piston 51 by the pressurized air decreases and in turn, a main spring 57 exerts a force to push the second piston 51 to cause the second piston 51 to block the outlet 54. The electromagnetic valve 6 is closed to expel air out of the inlet passage 60, the sling member 50 moves rearward to its inoperative position by a spring element 59 put on the axial channel 52. Thus, pressurized air from the pressure adjustment chamber 12 enters the firing chamber 10 to be configured for a next firing. The electromagnetic valve 6 can be opened by pulling a trigger 8.

While the invention has been described in terms of preferred embodiments, those skilled in the art will recognize that the invention can be practiced with modifications within the spirit and scope of the appended claims.

What is claimed is:

1. A firing mechanism of an airsoft gun including a gun body having an internal, rear sleeve, comprising:

a spring biased discharge tube in a front end of the sleeve;

a retaining ring on the front end of the sleeve;

at least one assembly, each including an air canister and a piercing member facing the air canister;

a locking member put on a rear end of the sleeve and configured to rotate to cause the piercing member to pierce the air canister of each of the at least one assembly;

the spring biased discharge tube communicating with the at least one assembly;

a first inlet passage with the discharge tube extending therein;

a pressure adjustment chamber in a front end of the first inlet passage;

a second space in the pressure adjustment chamber for storing pressurized air supplied from the at least one assembly via the discharge tube and the first inlet passage;

a spring biased first piston in a rear portion of the second space;

a first passage in front of the first inlet passage;

an adjustment member threadedly secured to the pressure adjustment chamber and with the first inlet passage and the first passage formed therein;

a third space between the first passage and the first piston;

an axial tunnel through the first piston;

a plug in a rear portion of the axial tunnel;

at least one lateral hole through the first piston and communicating with the axial tunnel so that the pressurized air in the second space having a pressure above a predetermine value pushes the first piston rearward to block the first passage, decrease a volume of the third space to about zero, and block the at least one lateral hole;

a passageway in the gun body;

a firing chamber communicating with the second space via the passageway and disposed besides the pressure adjustment chamber wherein the pressurized air is configured to enter the firing chamber via the second space;

a spring biased second piston configured to block the firing chamber;

a spring biased sliding member having an axial channel;

an outlet facing a rear end of the sliding member;

a third piston in the gun body;

an outlet member communicating with both the second space and the passageway;

a pressurized air guide channel for guiding the pressurized air from the passageway to the firing chamber wherein the pressurized air further enters a space between the second piston and the third piston, furthermore enters a first channel via a first guide hole adjacent to a rod in the second piston, and the pressurized air in turn enters the second piston via the first channel to cause the third piston to block the outlet;

an electromagnetic valve under the firing chamber and being configured to activate by pulling a trigger; and a second inlet passage communicating with both the electromagnetic valve and the firing chamber wherein the second inlet passage is configured to open by opening the electromagnetic valve and the pressurized air flows from the second inlet passing to a rear end of the sliding member via a second guide hole, a first passage member, and a second passage member, the sliding member moves forward to push a pellet, a force exerted to a front end of the third piston increases to open the outlet, the third piston moves rearward, and the pressurized air flowing from the firing chamber to drive the pellet out of the gun body.

* * * * *